US005860589A

United States Patent [19]

Hsu

[11] Patent Number: 5,860,589

[45] Date of Patent: Jan. 19, 1999

[54] PACKING BOX

[76] Inventor: Wen Yu Hsu, P. O. Box 82-144, Taipei, Taiwan

[21] Appl. No.: 736,667

[22] Filed: Oct. 25, 1996

[51] Int. Cl.[6] ..... B65D 5/42

[52] U.S. Cl. ..... 229/162; 40/312; 206/232; 229/921

[58] Field of Search ..... 229/92.8, 162, 229/921; 206/232, 767, 45.29, 45.3; 40/312, 156

[56] References Cited

U.S. PATENT DOCUMENTS

| | | | |
|---|---|---|---|
| 610,337 | 9/1898 | Ames | 229/921 |
| 910,576 | 1/1909 | Randall | 229/921 |
| 1,570,533 | 1/1926 | Styll | 229/921 |
| 2,655,260 | 10/1953 | Clerc | 206/232 |
| 3,415,407 | 12/1968 | Alden et al. | 229/921 |
| 3,568,827 | 3/1971 | Haring | 229/162 |
| 4,780,975 | 11/1988 | Friedman | 229/92.8 |
| 4,978,006 | 12/1990 | Juteau | 206/232 |
| 5,232,087 | 8/1993 | Schluger | 229/921 |
| 5,277,307 | 1/1994 | Kelly | 206/232 |
| 5,469,965 | 11/1995 | Stearns | 229/92.8 |

*Primary Examiner*—Gary E. Elkins
*Attorney, Agent, or Firm*—Hitt Chwang & Gaines, P.C.

[57] ABSTRACT

A packing box made from a patterned cardboard having a bottom panel, a top panel, two side panels, a front panel, and a rear panel, wherein a rectangular bottom frame is extended from one long side of the bottom panel remote from the front panel, having two adhesion flaps respectively extended from one long side and one short side thereof and adhered to the bottom panel at an outer side, defining with the bottom panel a bottom window and an insertion hole at one side for the insertion of a card into the bottom window; a rectangular top frame is extended from one long side of one side panel remote from the bottom panel, having two adhesion flaps respectively extended from one long side and one short side thereof and adhered to the top panel at an outer side, defining with the top panel a top window and an insertion hole at one side for the insertion of a card into the top window.

1 Claim, 3 Drawing Sheets

PACKING BOX

BACKGROUND OF THE INVENTION

The present invention relates to packing boxes, and relates ore particularly to such a packing box which has two integral frames at two opposite sides for the loading of advertising cards.

Regular paper packing boxes for packing cigarettes, food, etc., are commonly made by cutting a cardboard into the desired pattern, then folding up the patterned cardboard into shape and fixing it by an adhesive. These packing boxes may be printed with advertising words, directions for use, cautionary statement, precautionary statement, etc. However, a packing box has only a limited printing surface area. Furthermore, when printed, the content of the printing can no longer be changed.

SUMMARY OF THE INVENTION

The present invention provides a packing box which has frame means on the outside for the loading of advertising cards. According to the present invention, the packing box is made from a patterned cardboard having a bottom panel, a top panel, two side panels, a front panel, and a rear panel, wherein a rectangular bottom frame is extended from one long side of the bottom panel remote from the front panel, having two adhesion flaps respectively extended from one long side and one short side thereof and adhered to the bottom panel at an outer side, defining with the bottom panel a bottom window and an insertion hole at one side for the insertion of a card into the bottom window; a rectangular top frame is extended from one long side of one side panel remote from the bottom panel, having two adhesion flaps respectively extended from one long side and one short side thereof and adhered to the top panel at an outer side, defining with the top panel a top window and an insertion hole at one side for the insertion of a card into the top window.

DETAILED DESCRIPTION OF THE PREFERRED EMBODIMENT

Figure 1:
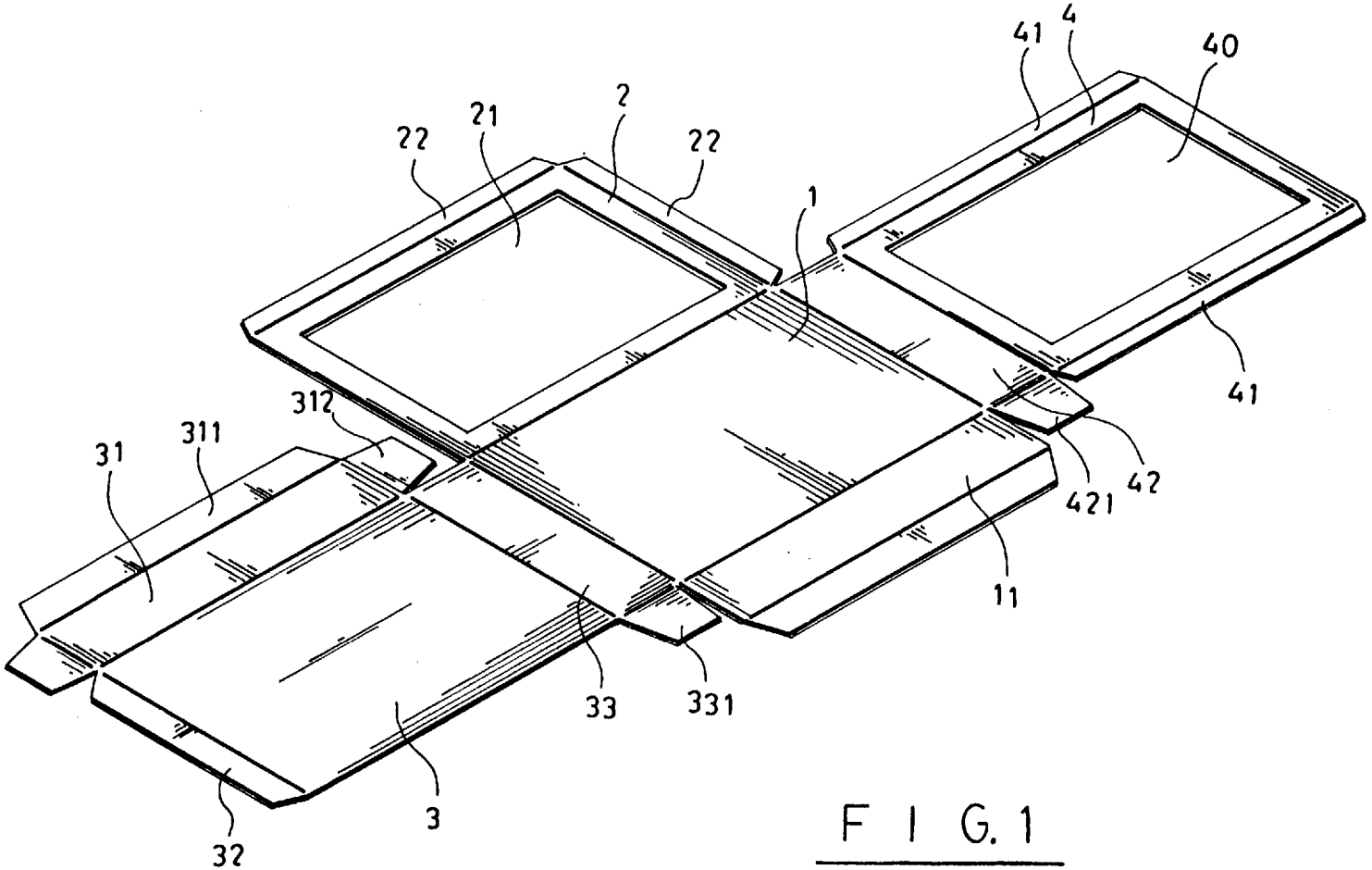
FIG. 1 shows a patterned cardboard extended out according to the present invention.

A packing box in accordance with the present invention is obtained by cutting a cardboard into a predetermined pattern by a punch press, having a rectangular shape. FIG. 1 shows the patterned cardboard extended out. As illustrated, the patterned cardboard comprises a rectangular bottom panel 1, a rectangular top panel 3 and a rectangular top frame 4 respectively connected to two opposite short sides of the bottom panel 1, a rectangular bottom frame 2 and a rectangular front panel 11 respectively connected to two opposite long sides of the bottom panel 1, a rectangular left side panel 33 connected between the bottom panel 1 and the top panel 3, a rectangular right side panel 42 connected between the bottom panel 1 and the top frame 4, a left side cover flap 331 extended from one short side of the left side panel 33 adjacent to the front panel 11, a right side cover flap 421 extended from one short side of the right side panel 42, a rectangular rear panel 31 connected to one long side of the top panel 3 adjacent to the bottom frame 2, a rear insertion flap 311 extended from one long side of the rectangular rear panel 31 remote from the top panel 3, two rear cover flaps 312 respectively extended from two opposite short sides of the rear panel 31, a top panel adhesion flap 32 extended from one short side of the top panel 3 remote from the left side panel 33, two bottom frame adhesion flaps 22 respectively extended from one short side and one long side of the bottom frame 2, two top frame adhesion flaps 41 respectively extended from two opposite long sides of the top frame 4, a bottom window 21 defined within the bottom frame 2, and a top window 40 defined within the top frame 4.

Figure 2:
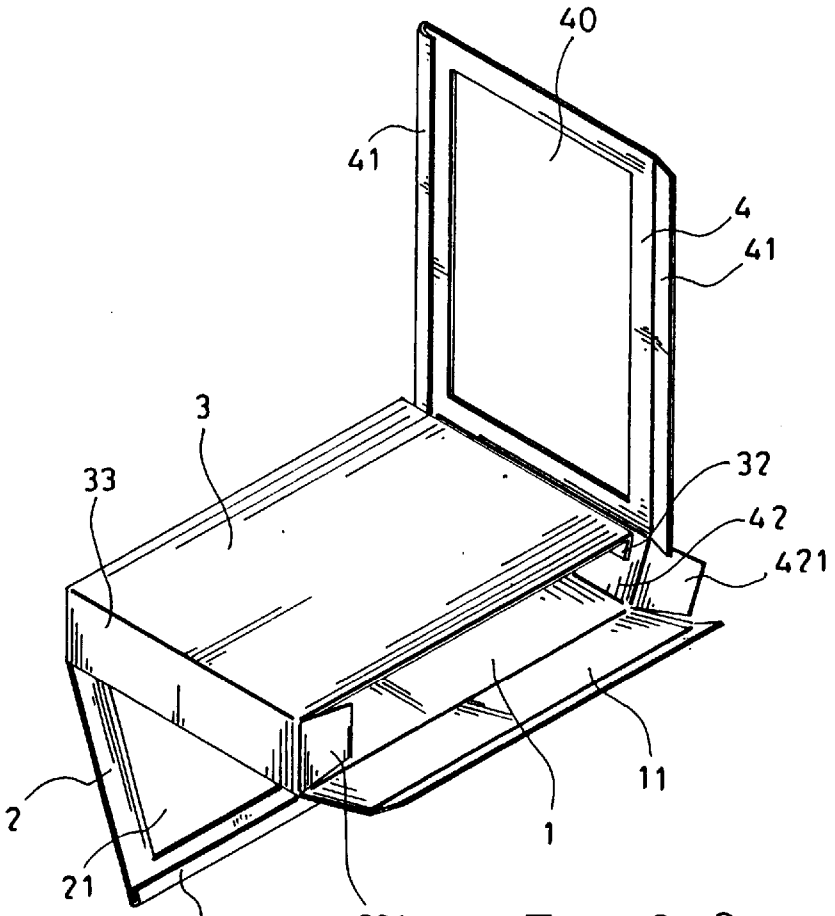
FIG. 2 shows the patterned cardboard folded up; and, FIG. 3 is an elevational view of a finished packing box according to the present invention.
Figure 3:
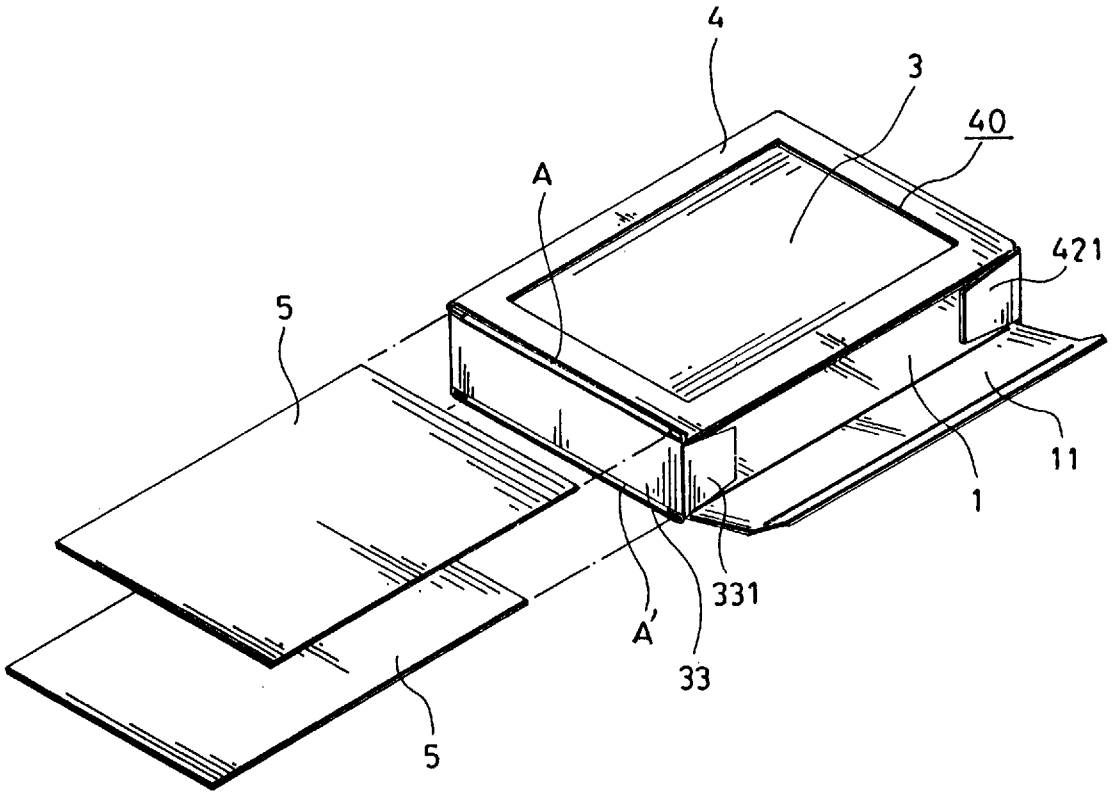

Referring to FIGS. 2 and 3, the left side panel 33 and the right side panel 42 are respectively folded up to a vertical position perpendicular to the bottom panel 1, then the top panel adhesion flap 32 is adhered to the inside surface of the right side panel 42 by an adhesive, and then the top frame adhesion flaps 41 are respectively inwardly folded up through 180° and adhered to the top panel 3 by an adhesive, permitting an insertion hole A to be formed between the top frame 4 and the top panel 3 (see FIG. 3), and then the rear panel 31 and the insertion flap 311 and the rear cover flaps 312 are respectively inwardly folded up through 90° and inserted into the space defined within the top panel 3., the bottom panel 1, the left side panel 33 and the right side panel 42, and then the bottom frame adhesion flaps 22 are respectively inwardly folded up through 180° and the bottom frame 2 is outwardly folded up and closely attached to the outside surface of the bottom panel 1, and then the bottom frame adhesion flaps 22 are respectively adhered to the bottom panel 1 by an adhesive, permitting an insertion hole A' to be formed between the bottom panel 1 and the bottom frame 2 at one side. When finished, advertising cards 5 can be inserted through the insertion holes A, A' into the windows 21, 40.

What the invention claimed is:

1. A packing box made from a patterned cardboard comprising a rectangular bottom panel, a front panel extended one long side of said bottom panel, a rectangular left side panel and a rectangular right side panel respectively extended from two opposite short sides of said bottom panel, and a rectangular top panel extended from one long side of said left side panel remote from said bottom panel, a rear panel extended from one long side of the top panel, wherein a rectangular bottom frame is extended from one long side of said bottom panel remote from said front panel, having two adhesion flaps respectively extended from one long side and one short side thereof and adhered to said bottom panel at an outer side, defining with said bottom panel a bottom window and an insertion hole at one side for the insertion of a card into the bottom window; a rectangular top frame is extended from one long side of said right side panel remote from said bottom panel, having two adhesion flaps respectively extended from one long side and one short side thereof and adhered to said top panel at an outer side, defining with said top panel a top window and an insertion hole at one side for the insertion of a card into the top window.

* * * * *

UNITED STATES PATENT AND TRADEMARK OFFICE

CERTIFICATE OF CORRECTION

PATENT NO. : 5,860,589

DATED : January 19, 1999

INVENTOR(S) : Hsu

It is certified that error appears in the above-indentified patent and that said Letters Patent is hereby corrected as shown below:

Col. 1, line 2 "ore" should be --more-- .

Signed and Sealed this

Eleventh Day of May, 1999

*Attest:*

*Attesting Officer*

Q. TODD DICKINSON

*Acting Commissioner of Patents and Trademarks*